US011435067B1

(12) United States Patent
Wood et al.

(10) Patent No.: US 11,435,067 B1
(45) Date of Patent: Sep. 6, 2022

(54) COILABLE LIGHTING APPARATUS WITH BISTABLE MAST

(71) Applicant: RTL Materials Ltd., Lymington (GB)

(72) Inventors: Richard Wood, Lymington (GB); Jean-Christophe Detis, Castelnau le Lez (FR)

(73) Assignee: RTL MATERIALS LTD., Lymington (GB)

( * ) Notice: Subject to any disclaimer, the term of this patent is extended or adjusted under 35 U.S.C. 154(b) by 0 days.

(21) Appl. No.: 17/190,606

(22) Filed: Mar. 3, 2021

(51) Int. Cl.

| | |
|---|---|
| ***F21V 21/22*** | (2006.01) |
| ***F21V 21/104*** | (2006.01) |
| ***F21V 21/092*** | (2006.01) |
| ***F21Y 103/10*** | (2016.01) |
| ***F21Y 115/10*** | (2016.01) |

(52) U.S. Cl.
CPC ..... *F21V 21/22* (2013.01); *F21V 21/092* (2013.01); *F21V 21/104* (2013.01); *F21Y 2103/10* (2016.08); *F21Y 2115/10* (2016.08)

(58) Field of Classification Search
CPC ..... F21V 21/22; F21V 21/092; F21V 21/104; F21Y 2103/10; F21Y 2115/10; E04C 3/005; B29L 2023/00; B32B 2597/00
USPC ..... 362/418
See application file for complete search history.

(56) References Cited

U.S. PATENT DOCUMENTS

| | | | | |
|---|---|---|---|---|
| 4,117,495 | A * | 9/1978 | Hochstein | H01Q 1/087 343/723 |
| 6,217,975 | B1 * | 4/2001 | Daton-Lovett | B65G 15/08 428/105 |
| 6,256,938 | B1 * | 7/2001 | Daton-Lovett | F16H 19/064 138/119 |
| 9,574,726 | B2 * | 2/2017 | Cselenyi | F21S 4/22 |
| 10,124,545 | B2 | 11/2018 | Daton-Lovett | |
| 2007/0171644 | A1 * | 7/2007 | Seibel | F21S 10/002 362/249.01 |
| 2011/0182066 | A1 * | 7/2011 | Webb | F21V 21/22 362/235 |
| 2013/0335972 | A1 * | 12/2013 | Hubner | B60Q 1/2657 362/253 |
| 2016/0177567 | A1 * | 6/2016 | Gandhi | E04C 3/005 52/108 |
| 2020/0180142 | A1 * | 6/2020 | Chow | B25J 13/089 |
| 2021/0277655 | A1 * | 9/2021 | Daton-Lovett | B32B 5/26 |

FOREIGN PATENT DOCUMENTS

| | | | |
|---|---|---|---|
| WO | 9608671 | A1 | 3/1996 |
| WO | 2014036629 | A1 | 3/2014 |
| WO | 2014186730 | A1 | 11/2014 |

* cited by examiner

*Primary Examiner* — Laura K Tso
(74) *Attorney, Agent, or Firm* — United IP Counselors, LLC

(57) ABSTRACT

The invention relates to a lighting assembly (1), comprising an extendible mast (2) constructed and arranged so as to be configurable between a coiled form and an extended form, wherein when extended the mast is resiliently biased in the form of an elongate tube having a slit along its length and wherein when coiled the mast is wound about an axis extending transversely to the longitudinal extent of the mast; and, a lighting element (6) supported by the mast and extending along at least a portion of the mast.

24 Claims, 6 Drawing Sheets

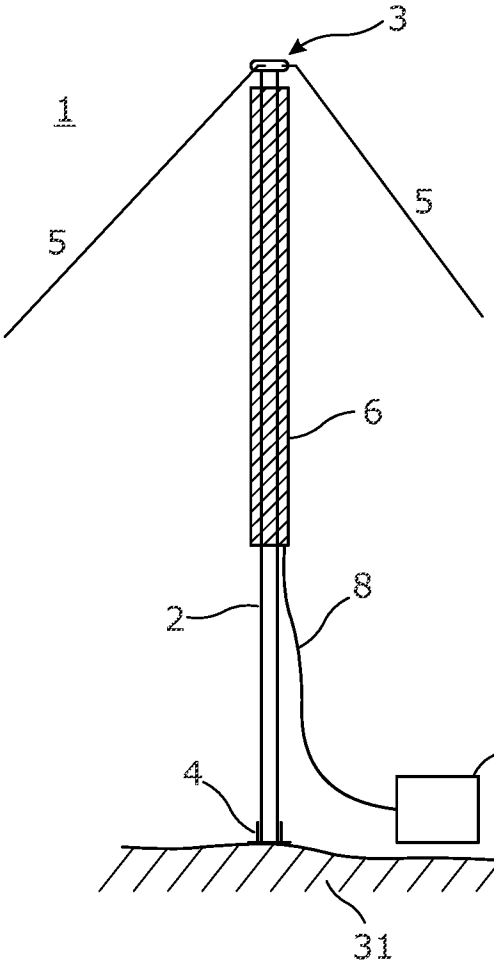
Figure 1
Figure 7
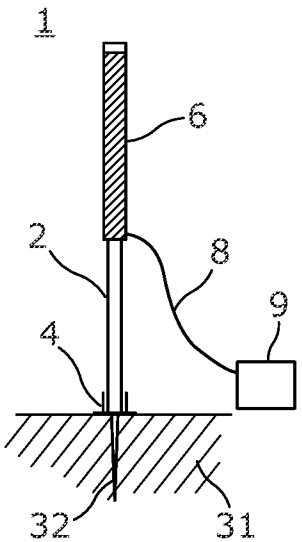
Figure 8
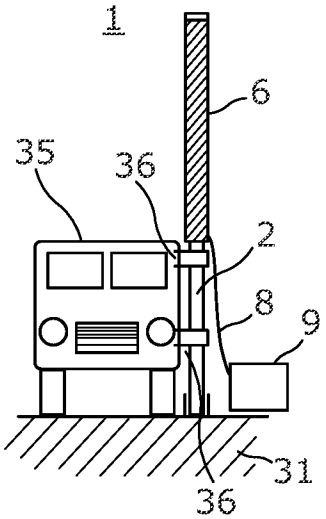
Figure 9
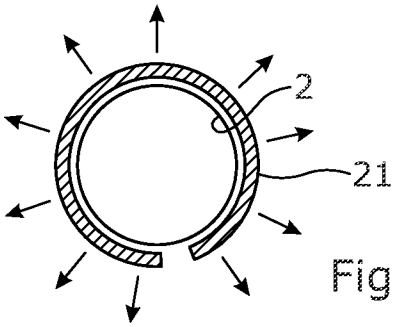
Figure 10

COILABLE LIGHTING APPARATUS WITH BISTABLE MAST

TECHNICAL FIELD

The present invention relates to a lighting apparatus, and to related methods and kit, and particularly to a lighting apparatus that can be stowed by coiling a support member and lighting element into a compact form, wherein the coiled support member extends and supports the lighting element during use.

BACKGROUND

There are various applications where it is required to illuminate an area on say a temporary basis where installing a permanent lighting system is not feasible or desirable. Such systems may need to be large, e.g. to support sufficient light emitting elements across sufficient surface area. Such systems may for instance have the desirable area lighting characteristics of a fluorescent tube or the like. It may furthermore be required for the lighting system to be portable so it can be transported to a site and erected as required. Such systems should therefore be ideally compact and lightweight for portability, robust, simple to assemble and deploy, and to stow. The system may also need to be flexible as to mounting arrangements, and connection to various sources of power, e.g. mains, battery, solar, etc. Possible applications include emergency services; military uses; camping, festivals and other outdoor or temporary installations and events; breakdown services; maintenance workers; etc. Many existing products relate to floodlights or light tubes mounted to telescopic poles carried by tripods or carriages. These have limited portability due to size and weight, and limited robustness.

BRIEF SUMMARY

The present invention aims to address some or all of these needs.

According to a first aspect of the present invention, there is provided a lighting assembly, comprising: an extendible mast constructed and arranged so as to be configurable between a coiled form and an extended form, wherein when extended the mast is resiliently biased in the form of an elongate tube having a slit along its length and wherein when coiled the mast is wound about an axis extending transversely to the longitudinal extent of the mast; and a, preferably rollable, lighting element supported by the mast and extending along at least a portion of the mast.

Preferably the lighting element extends along at least 50% of the longitudinal extent of the mast and/or at least 50% of the circumference of the mast. The lighting element may comprise plural light emitting elements, e.g. an array or strips of elements, such as LEDs.

Thus, the lighting assembly provides an extendible mast with a lighting element which advantageously allows compact storage and easy transportation to the site of intended use, with simple and quick installation for the user to get the system deployed. The lighting element and the mast may be coiled and extended together, or detached and coiled separately, greatly simplifying the deployment, storage and transportation of such devices. The lighting assembly can be stored and transported in its coiled/compact form, and then deployed by simply extending the mast which provides a substrate for positioning the lighting element, which are either already attached to the mast or are reversibly attached to the erect mast, for illuminating the desired area according to the application. Preferably no tools are required to attach the lighting element to the mast and/or to erect the mast. Various mounting arrangements are possible according to the application. In prior art schemes for deploying lighting element in the field, the lighting element would be spotlights or non collapsible lighting tubes, possibly attached to a telescopic frame or tripod, which is typically aluminium, by various fixing means, thus forming an assembly with limited stow ability and transportability and which takes the user much longer to erect. Such prior art schemes are clearly cumbersome and problematic compared with the present invention.

The lighting assembly can in principle be operated with a wide variety of lighting element types and different sizes of mast according to need. The mast is preferably made from a relatively thin material or materials to aid coiling, e.g. between 1 mm and 5 mm. The lighting element and/or the light emitting elements comprising the lighting element and any associated electronics and/or cables are preferably also thin, e.g. no more than 5 mm in some examples, so as not to significantly affect the ability of the mast to coil in examples where the lighting element is permanently attached. Thus, the lighting element can be entirely contained within the coiled mast without significantly adding bulk to the overall assembly.

Thus, preferred embodiments may light any place without having to worry about the environmental conditions, in particular for the supply of electrical energy to the site, the invention then having to benefit from a multiple connectivity which allows it to draw electrical energy from various structurally different sources: from the mains power grid, when the site to be lit has it, or from a battery, if applicable from a vehicle, or even from a generator, in case of use in areas not covered by electricity suppliers.

The installation can be set up quickly, without logistics or special equipment, and for example be transportable in the manner of a usual accessory for rapid intervention. It must therefore be light and compact so that a single person, once again, can quickly deploy and recover it. It is made up of basic elements that can be assembled without special skills and whose dimensions, at least in a compact state, as well as the weights, are such that they can be packed in a container easily transportable by one person.

The assembly has the capability of lighting an area with similar power to a street light typically found in an urban area. An installation like the one of the invention meets a need, particularly expressed by professions required to intervene in places which do not necessarily have conventional energy sources, and which intervene as operations requiring that the site is equipped with efficient lighting. In this regard, we can mention the firefighters, whose areas of intervention can obviously be found everywhere, and in particular in places away from lit urbanized areas.

In embodiments, the lighting element is formed from one or more light emitting elements, e.g. LEDs. The or each light emitting elements may have a significant extent (e.g. >50%) in the longitudinal direction of the mast, e.g. greater than 50 cm, or greater than 100 cm, or greater than 200 cm in some instances, for a typical mast of between 2 and 4 meters. In some embodiments, the light emitting elements can extend substantially all of the extent of the mast. In other embodiments, the light emitting elements are distanced from the bottom of the mast, by for example at least a quarter, or a half, or three quarters of the longitudinal extend of the mast, so as to be elevated when the lighting assembly is erected. The light emitting elements may extend substantially around the circumference of the extended mast, e.g. >=180 degrees or substantially surround the mast, e.g. >330 degrees.

The mast can progressively extend from being coiled to its slit tube form. Thus, in embodiments, the mast can be completely or partially extended when deployed, as desired to achieve optimal lighting. In an embodiment, the lighting element comprise a sheet of LED elements, e.g. in a matrix form, or plural strips of LED elements that can roll up when not un use.

In an embodiment, the light emitting elements are supported by a sleeve which when not in use is separable from the mast and which when in use envelops at least a portion of the mast.

In an embodiment, the sleeve is in the form of a strip which has attachment points allowing its longitudinal edges to be joined forming a sleeve around the mast. Thus, the sleeve can be simply attached by laying the extended mast on the strip of material and reversibly fastening it around the mast, e.g. via a zip or hook and loop material running or ties along the edges of the strip. The strip is thus flexible in the direction allowing it to wrap around the circumference of the mast. The sleeve may have a snug fit, such that it stays in place on the tube automatically when erected, or one or more fasteners can be used to prevent slip.

In an embodiment, the sleeve may be rollable or foldable for portable storage. Thus, the sleeve may be flexible in the longitudinal direction (i.e. in direction of the principal axis of the mast) which in most cases will be the longest dimension and so will allow the most compact form if folded/coiled in this direction.

In an embodiment, the lighting element is coupled to the mast such that they coil together. The lighting element may be bonded to a surface of the mast. Any suitable adhesive or bonding technique can be used according to the materials used for the lighting element and mast. This could be a post production step where the lighting element, e.g. strips of LEDs or other light emitting elements could be bonded to the mast, or the lighting element could be incorporated with the mast during the lamination stage.

The lighting element may be constructed so as to have a first direction that is relatively more tolerant to stress and/or strain than a second direction, wherein the second direction is angled relative to the principal axis of the extended mast. For instance, whilst flexible circuit board substrates are known, conductive traces are typically not suited for applications where they experience strains. In a BRC, surface strains are experienced in the longitudinal direction (and transverse direction) as the member coils/extends. It is also necessary to have conductive traces in a longitudinal direction to connect the LED elements which will run along a significant length of the mast. Thus, normal circuit board design will potentially cause early failure due to the strains experienced. Thus, by aligning conductors in sympathy with the underlying structure, this embodiment seeks to minimise these strains. For instance, the conductors can be at similar angles to the surface fibres in the laminated FRP, e.g. angled to the principal axis. Or conductors can be sinusoidal, etc. This helps avoid delamination or damage to the assembly due to the strains involved in coiling and extending the mast.

In an embodiment, the mast comprises a pocket that receives the lighting element such that the lighting element can slip relative to the mast. This relieves stresses and strains as the lighting element are loosely attached to the mast so that there can be relative movement between the two to accommodate strains when the mast is coiled and extended. The pocket may for example be formed by the mast comprising a sheet or sheets of material on the front or rear surface of the rest of the mast attached at different circumferential positions so as to form a space behind it, i.e. the pocket. The sheet or sheets may make no significant contribution to the structural requirements of the mast. Thus, the sheets can be thin which helps avoid any conflict with the rest of the mast being able to coil and extend.

In an embodiment, the lighting element is loosely coupled to the mast so they can slip relative to the mast.

In an embodiment, the mast comprises a reinforced composite. Thus, the mast can be made from layers of fibre reinforced polymer or the like. In an embodiment, the mast comprises a bistable material. It is anticipated that these materials will be preferred materials for forming the mast in many applications.

In an embodiment, the lighting assembly comprises a connector on the mast for connecting the lighting assembly to a power system. Where the lighting element is entirely enclosed within the material of the mast, a hole in the mast or wires protruding through the mast may be provided to access and connect to the lighting element or light emitting elements. The connector may be positioned on the mast at a distance from the lighting element, the assembly comprising a cable integrally coupled to the mast along a portion of the mast to connect the lighting element and connector, the mast and cable are coiled together. A pocket at a side edge of the mast may be used for the cable to be retained. Due to the slit tube form of the mast, two side edges are formed running the longitudinal extend of the mast, either or both of which can be provided with a pocket formed in the material of the mast or from additional material bonded or fixed to the mast. In the coiled configuration, the mast is flattened out at the slit in the tube so that the side edges are at the sides of the coil. Thus, the cable in the pocket is coiled with the mast at the sides of the coil such that it lies outside the footprint of the mast, i.e. it is not in the interstitial spaces of the coiled mast, meaning that the coiling of the cable does not interfere with the coiling of the mast. Alternatively the cable can run in a pocket along the body of the mast. The cable can be used to connect externally to the lighting element, or to connect together adjacent ones of individual light emitting elements, with the pocket providing similar advantages.

In an embodiment, the assembly comprising mounting fittings, being one or more of:

a top cap for fitting to the end of the mast, by which guy ropes can tether the mast in position on the ground;

a bottom cap for fitting to the bottom of the mast and positioning the bottom of the mast on the ground, optionally having a downwardly extending stake for anchoring the assembly in the ground;

a tripod or other stand for balancing the assembly on the ground and engaging with and positioning the mast at the desired orientation; and one or more suction cups or magnetic cups for attaching the mast to a vehicle or other wall, wherein the mounting fittings couple to the mast and support the mast in a deployed position.

In an embodiment, the lighting assembly is attached in a horizontal position to a ceiling, either singularly or daisy chained together drawing from the same single power source.

In an embodiment, the assembly is stowable with at least one part accommodated within the centre of the coil formed by the mast to reduce the overall space required to stow the assembly.

In a second aspect, there is provided a method of deploying a lighting assembly, the lighting assembly comprising: an extendible mast constructed and arranged so as to be configurable between a coiled form and an extended form, wherein when extended the mast is resiliently biased in the form of an elongate tube having a slit along its length and wherein when coiled the mast is wound about an axis extending transversely to the longitudinal extent of the mast, the method comprising:

extending the mast from the coiled form to the extended form;

attaching a lighting element to the mast, wherein the lighting element is in the form of a strip which attaches around the circumference of the tube to form a sleeve; and positioning the mast so as to elevate the lighting element.

In a third aspect there is provided a method stowing a lighting assembly by following the above mentioned steps in reverse.

In another aspect, there is provided transportable area lighting installation characterized in that it comprises:

a rectilinear mast, convertible between two states respectively folded into a compact volume and deployed in a rectilinear tubular configuration in the direction of the axis of the mast;

a flexible strip equipped with light-emitting diodes LEDs, transformable between two states respectively into a winding strip and in the configuration deployed as a sleeve by fixing the two opposite longitudinal edges of the strip;

the dimensions in section of the deployed mast and of the strip configured as a sleeve being provided so that said sleeve can be fitted onto the deployed mast;

a power supply connected to the light-emitting diodes LEDs and provided with means of connection to a source of electrical energy; and means for fixing the mast to the ground or to a wall.

Once folded and/or rolled up, the two potentially most bulky elements, at least in their deployed configuration, occupy a very small volume, of the same order as the volumes of the other components of the system of the lighting installation, e.g. fixing means, battery, etc. They are typically all suitable for being stored in a bag, particularly with a strap that can be carried by one person, and the weight of which does not exceed a few kg, for example of the order of 5 to 7 kg. In addition, they are all capable of constituting a lighting kit, the various components of which can be stored in such a bag.

In an embodiment, the mast can consist of a flexible sleeve which can be flattened in a direction perpendicular to its axis and rolled up in the direction of said axis. This is a component that is known per se. Flattened and rolled up, its volume is minimal since the internal void that exists for example in the tubular configuration of the mast in the extended version no longer exists. It should be noted that said mast may have an axial length of several meters in the deployed state, for example from 3 m to 5 m.

In an embodiment, the support of the light sources, namely the strip or strips of light-emitting diodes LEDs, may have on its two longitudinal edges the two corresponding parts of a zipper over substantially its entire length. In other words, the strip can be opened lengthwise, unfolded width wise, into a flat element (in 2D) one side of which is fitted with LEDs. This flat element can then be very easily rolled up to obtain a rolled-up volume of the same size as the rolled-up volume of the mast. In the "deployed" configuration, the strip becomes a sleeve (a 3D element) by fixing the longitudinal edges to each other.

In an embodiment, to widen the possibilities of connecting the power supply to various sources of electrical energy, and to make the invention more universal, the electrical connection means comprise at least one socket for connection to the mains, or to a battery for example vehicle, or a generator. In many situations, the installation of the invention will be dependent on the electrical energy of a vehicle, and will therefore have to be connected to the battery of the latter. In the event that a building connected to the electrical network is nearby, connection to it is obviously possible, for example by means of an extension cord.

In an embodiment, the intervention sites with the installation of the invention are multiple, and the environments very diverse. So that the pole to be illuminated, functioning in reality as a transportable urban luminaire, can be correctly installed, several possibilities are possible. Thus, in a remote site accessible with a vehicle, the latter can be used as a fixed support. In this case, the fixing means may include suction cups which can be fixed to a flat wall in pairs aligned perpendicular to (or forming a non-zero angle with) the direction of fixing of the mast, separated by a distance greater than the width of the mast. ci, and provided with hooks for securing elastic links, for example closed-loop bracelets. Alternatively, the fixing means may comprise, on the one hand, at least one magnetic sole (in particular semi-rigid) which can be fixed to a wall, in particular flat (in particular by pairs of magnetic soles aligned perpendicular to the direction of fixing. of the mast or by forming a non-zero angle with the fixing direction of the mast, separated by a distance greater than the width of the latter) and, on the other hand, securing means for securing the mast and said at least one magnetic sole (in particular by being provided with hooks for securing elastic links, for example closed-loop bracelets). The wall can, in these cases, be a side door of the vehicle. The luminaire therefore rises from the vehicle, the illuminated part surmounting it to a large extent.

In an embodiment, the mast can be erected vertically to the ground away from any ancillary support. According to one possible configuration, the installation comprises for this purpose two end pieces, which can be fixed to the ends of the mast in the deployed position, each having a central tubular portion of a smaller diameter the internal diameter of the mast and an end flange with holes. The collar of one of the end caps serves as a base when fixing to the ground. The installation then also includes adjustable length guy ropes.

In an embodiment, the installation includes means for fixing the mast to the ground. These fixing means then comprise means for fixing one of the end pieces to the ground and/or means for fixing the stay cables in the ground. The means for fixing the guy ropes and the end pieces to the ground may for example be stakes, in particular metal. In this configuration, when the mast is erected, it can be immobilized in one location by driving a stake through at least one hole in the collar of the lower mast end, which rests on the ground. Guy lines are then secured to the upper end via the same holes, then secured to the ground at their other end via stakes.

In an embodiment, the strip may include light-emitting diode ribbons comprising a number of diodes ensuring a luminous flux of a power appropriate to the application, with outdoor area lights being typically 30,000 lumens. Likewise on a dimensional level, the mast may have a length of at least 3 m, typically of the order of 4 to 5 m. If the mast has a height of 4 m, the weight of the assembly, that is to say of the mast equipped with the strip (configured as a sleeve) with its strips of light-emitting diodes LEDs, does not exceed 3 kg, which is reasonable considering the necessary transportability of the luminaire.

Another aspect relates to a flexible strip equipped with light-emitting diodes LEDs, which can be combined in particular with a mast in the manner explained above. We have seen that it can be transformed between two states, respectively into a winding strip and into a deployed configuration as a sleeve by fixing the two opposite longitudinal edges of the strip. More specifically, as also mentioned above, the strip comprises on said longitudinal edges the two corresponding parts of a zipper over substantially its entire length.

It is then easy to bring them together, then butt them in order to secure them to each other by operating the zipper. We thus go from a two-dimensional (2D) configuration, that of the flat strip, to a configuration in three dimensions (3D), that of the substantially cylindrical sleeve with a hollow central core.

In an embodiment, in this strip, the light-emitting diodes LEDs are arranged as ribbons of parallel longitudinal diodes. These parallel longitudinal diode ribbons are attached to a net or connected to each other by a net, which is secured, in particular sewn, to a fabric made from nylon fibres. The net in question is preferably a very tight mesh net of the mosquito net type. Alternatively (or even preferentially), the strips of parallel longitudinal diodes are positioned on a flexible support (in particular textile, preferably coated and/or waterproof) and are completed by a film, which is transparent or translucent, which is positioned by-above the diode ribbons as well as over the flexible support, and which is fixed to this flexible support (in particular by welding, for example by high-frequency), this between the diode ribbons and/or on both sides. other of each diode strip. This flexible support and this film then define parallel longitudinal cavities (more particularly taking the form of parallel tunnels or the like) inside which the diode ribbons are positioned. In fact, these parallel longitudinal diode ribbons can be inserted into such parallel longitudinal cavities (parallel tunnels) which are defined, on the one hand, by the flexible support (in particular textile, preferably coated and/or waterproof) and, d on the other hand, by the film, which is transparent or translucent, and which is fixed (in particular welded, more particularly by high frequency) on the flexible support.

In an embodiment, the strip may also include at least one end a fold provided with a mechanical closure by hooks and textile loops, textile known under the trademark Velcro. It serves as a cover for the wiring conductors connecting the LED strips of the strip to an end socket provided for connection to the external electrical energy supply system, via the installation's own power supply.

In an embodiment, the lighting assembly comprises a housing for containing the coiled mast and guiding the mast as it is extended.

It will be appreciated that any features expressed herein as being provided "in one example" or as being "preferable" or an embodiment may be provided in combination with any one or more other such features together with any one or more of the aspects of the present invention.

BRIEF DESCRIPTION OF THE DRAWING FIGURES

Embodiments of the present invention will now be described by way of example with reference to the accompanying drawings, in which:

FIG. 1 shows a perspective view of an example of a lighting assembly in a deployed configuration according to an embodiment of the present invention;

FIGS. 7 to 9 show other examples of deployment of a lighting assembly in the deployed configuration;

FIG. 10 shows in cross section the lighting assembly;

DETAILED DESCRIPTION

Figure 12:
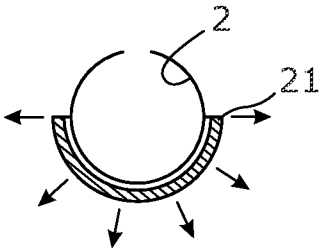
FIG. 12 shows in cross section the lighting assembly of FIG. 11.

FIG. 1 shows an example of a lighting assembly 1. The assembly 1 comprises an extendible mast 2 incorporating attached or integral lighting element 6 formed from one or more light emitting elements along some or all of its length (shown in hatched line in the example of FIG. 1). References made herein to the longitudinal or axial direction of the mast 2 or lighting assembly generally refer to the direction in which the mast is extended. The mast 2 has a top cap 3 and a bottom cap 4 which attach to the ends of the mast. Optionally, tethers 5 are attached the top of the mast or to the top cap 3 and are pinned to the ground to help anchor the lighting assembly 1 in place. Alternatively, the assembly 1 can be self supporting.

Figure 2:
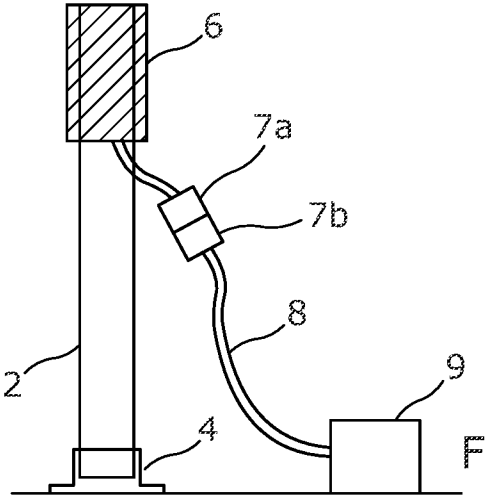
FIG. 2 shows a detail view of a connector for use with the lighting assembly of FIG. 1.

The lighting assembly also has a lighting element 6 attached to or integrally coupled to the mast 2. As shown by the detailed view of FIG. 2, the lighting assembly 1 has a connector 7*a* by which electrical connection can be made to provide power to the lighting assembly 1 by a cable 8 for connecting the lighting assembly 1 to a power source 9, here a 24 V battery, via a mating connector 7*b*. Where the connector 7*a* is at some distance from the lighting element 6, the mast may include a cable 8 to connect the two.

Figure 3:
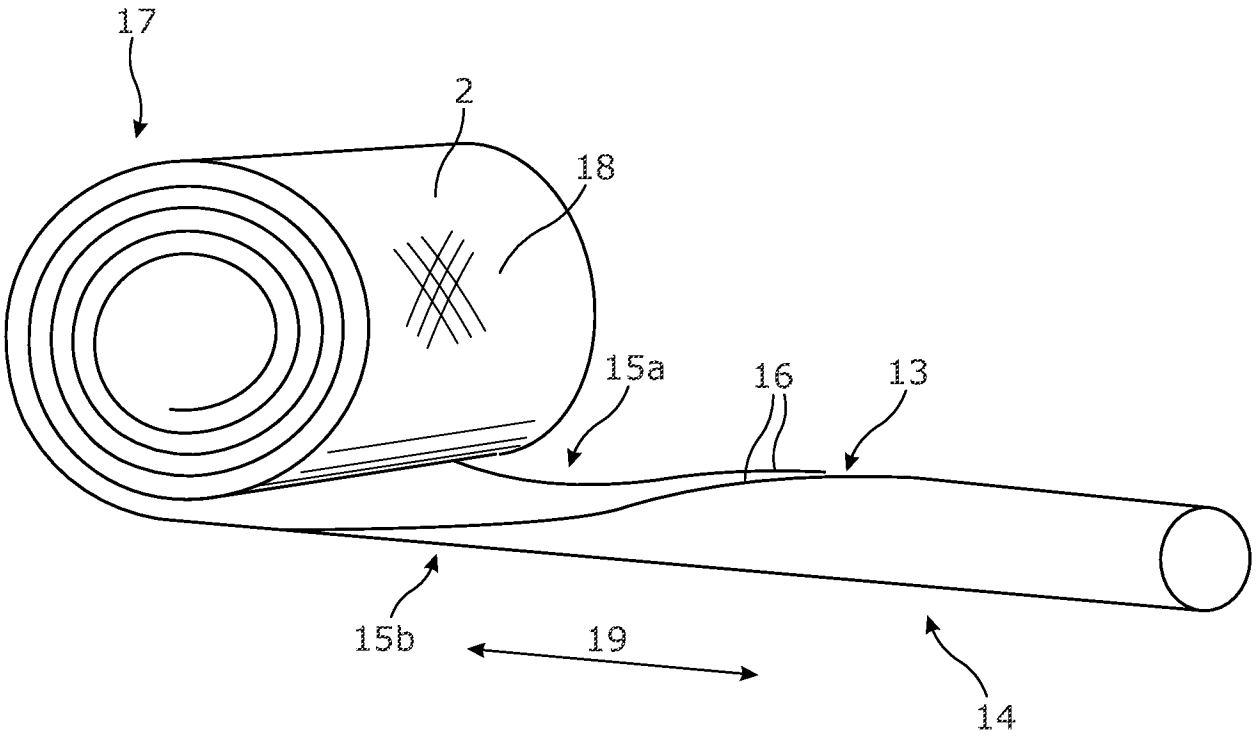
Figure 3 Prior Art
FIG. 3 shows an example of an extendible member suitable for use with the lighting assembly.

The extendible mast 2 has the form of a STEM (slit tubular extendible member). Thus, as shown in more detail in FIG. 3, the mast 2 is formed of an elongate member of sheet-like material, i.e. the member is thin in cross section, e.g. typically between 1 mm and 5 mm. The member can be opened out into a flat form allowing it to be wound into a coil 17. The extended portion 14 is resiliently biased to have a cross section that is curved, in this example, in the form of a circle or partial circle. Thus when fully extended, the member is resiliently biased in the form of a slit tube. The sides 16 of the tube may meet or overlap to form a full tube, or a gap 13 may be left. Cross sections other than circular may be used. For example, ovals and other continuous, non-circular arcs for the cross section can also be produced. The cross section may have straight portions between curved portions whilst being generally curved.

Thus, with the end cap 3 and bottom cap 4 removed and, where applicable, with the lighting element 6 detached from the mast, the mast 2 can be progressively wound/unwound around an axis perpendicular to its longitudinal extent 19 between a fully coiled form and a fully extended form. If desired, a housing can be provided to contain the coiled lighting assembly and to help guide the extension of the mast. The lighting element 6 either coils with the mast, where permanently attached, or where removed can preferably collapse or rollup to similarly adopt a compact form for storage and transport.

The techniques described herein allow the production of STEM type masts 2 that support the lighting element 6, reducing pack size and often weight and greatly simplifying the deployment of a lighting element. Whilst the techniques could allow the production of mast and lighting element assemblies using any mast 2 that falls into the general category of a STEM, it is anticipated that implementation will in many cases use composites, Fibre Reinforced Plastics (or Polymers) (FRPs) or Bistable Reelable Composite type devices, as their characteristics are well suited to this type of use. Other material, such as polymers with good elastic properties or metals may be used but in general FRP produce a product of superior performance.

FRPs are known per se and are not described in detail herein. However, in brief, FRPs are composite materials made of a polymer matrix reinforced with fibres. The fibres are usually fiberglass, carbon, or aramid, while the polymer is usually an epoxy, vinylester or polyester thermosetting plastic or thermoplastic, such as polypropylene, polyethylene nylon or poly-ether-ether-ketone. Although the use of thermosetting resins has formed the traditional basis for FRP manufacture, thermoplastic matrix polymers are increasingly being used, due to their speed of production and often superior mechanical performance. The matrix is a tough but relatively weak plastic that is reinforced by stronger stiffer reinforcing filaments or fibres. The extent that strength and elasticity are enhanced in a fibre reinforced plastic depends on the mechanical properties of both the fibre and the matrix, their volume relative to one another, and the fibre length and orientation within the matrix. Suitable FRPs may be manufactured by consolidating or laminating different layers of material together.

In the present example, the material used for the mast 2 is bistable, having a first stable form in the slit tube extended form 14 (in which it has a first curvature), and a second stable form when coiled into a coiled form 17 (in which it has a second curvature). Examples of bistable coilable members are disclosed in the Applicant's U.S. Pat. No. 6,217,975 the entire contents of which are hereby incorporated by reference. The member may be constructed with edges as described in the Applicant's U.S. patent application Ser. No. 16/488,116 filed 22 Feb. 2018, the entire contents of which are hereby incorporated by reference, to increase performance of the members. Conventional methods can be used to make the composite or bistable member. Advantageous mechanised production methods of making a composite member are disclosed in the Applicant's 10,124,545B the entire contents are hereby incorporated by reference. Using a bistable member in this way means that the coiled sleeve is stable, meaning that it is easier to handle and store, etc.

In general, the member 1 is manufactured as a fibre-reinforced composite in which various plies of woven, braided or angled fibres 18 (shown in part in FIG. 3) are laid up in a mould or former and heat and/or pressure applied to melt the thermoplastic matrix material consolidate the layers into a composite product. To achieve bistability, at least two plies positioned in the layup towards the intrados 15*a* and/or extrados 15*b* faces of the tubular member (i.e. away from the neutral axis of bending of the member), are angled with respect to the longitudinal axis 9 of the product to as to create non-isotropic layers with a high Poisson's ratio. In known examples, a layup of plies with angles of +45, −45, 0, +45, −45 may be used.

Thus, opening out the first curvature of the tube 4 gives rise to tension in the fibres 18 near the intrados face 15*a* which due to their angle has a component in the longitudinal direction which tends to cause a contraction in this layer in the longitudinal direction. As the tube is opened out to a flatter form, its bending stiffness in a transverse direction decreases. Once the component of the tension arising in the fibres in the longitudinal is sufficient to overcome the bending stiffness it flips the member into having a secondary curvature in the longitudinal direction, i.e. acting to coil the member, and the tension in those fibres is relieved by that layer contracting. A similar effect is produced by the fibres at the extrados face compressing as the tube is opened out, giving rise to a force component in the longitudinal direction in that layer that tends to cause extension in this layer in the longitudinal direction, which again promotes coiling. Thus, due to the orientation of the fibres, as a portion of the slit tube is opened out, it "flips" into a stable coiled form which relieves partially or fully the strains in the fibres and is thus stable. The member is thus reversibly configurable between a stable coiled form and a stable tubular form by progressively flattening and coiling from one end to coil the member, and extending the member from the coil to assume the tubular form.

Figure 4:
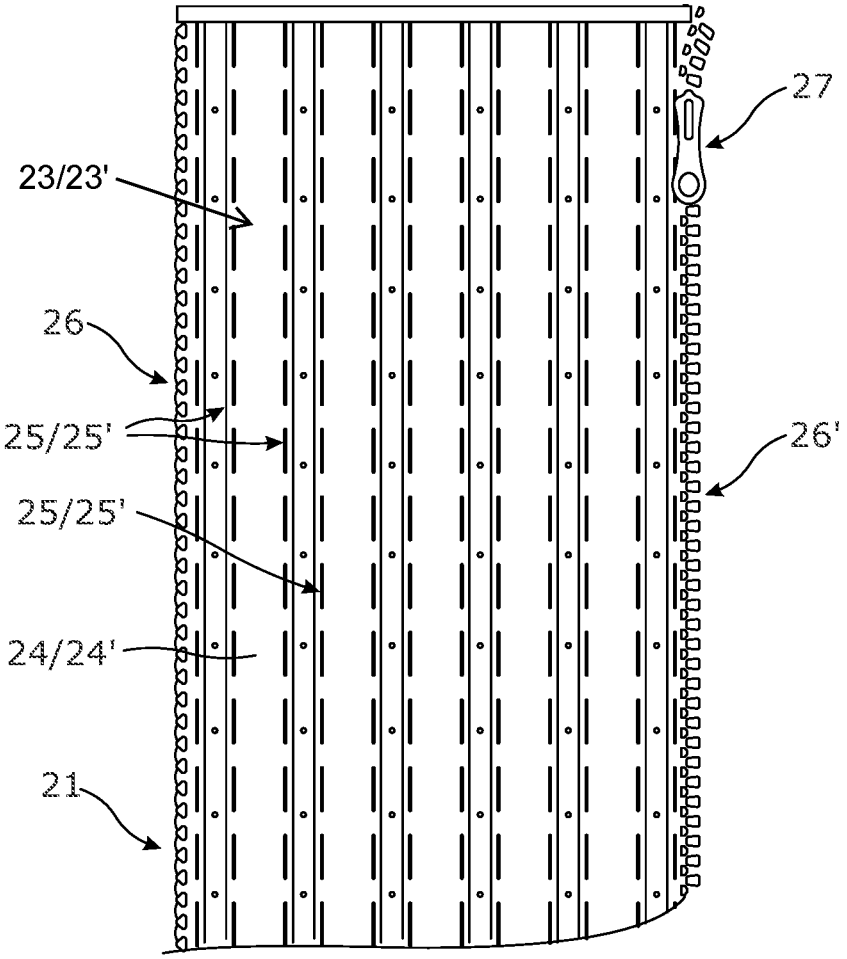
FIG. 4 shows an example of a lighting strip as part of a lighting assembly.
Figure 4:
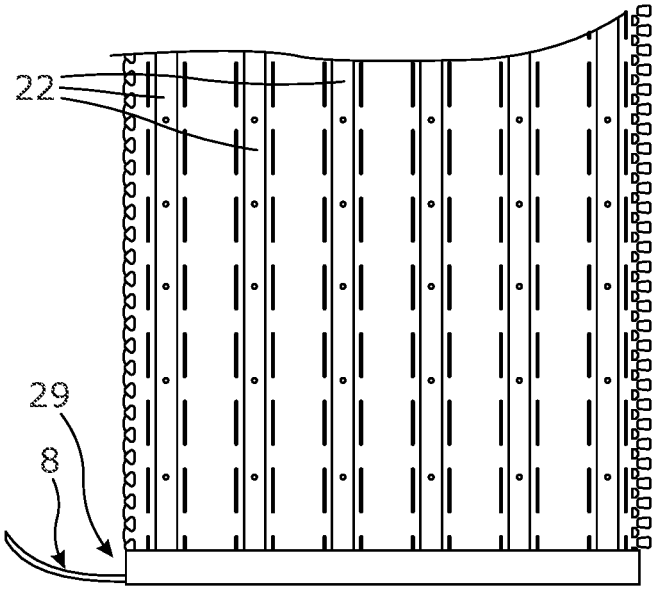
Figure 5:
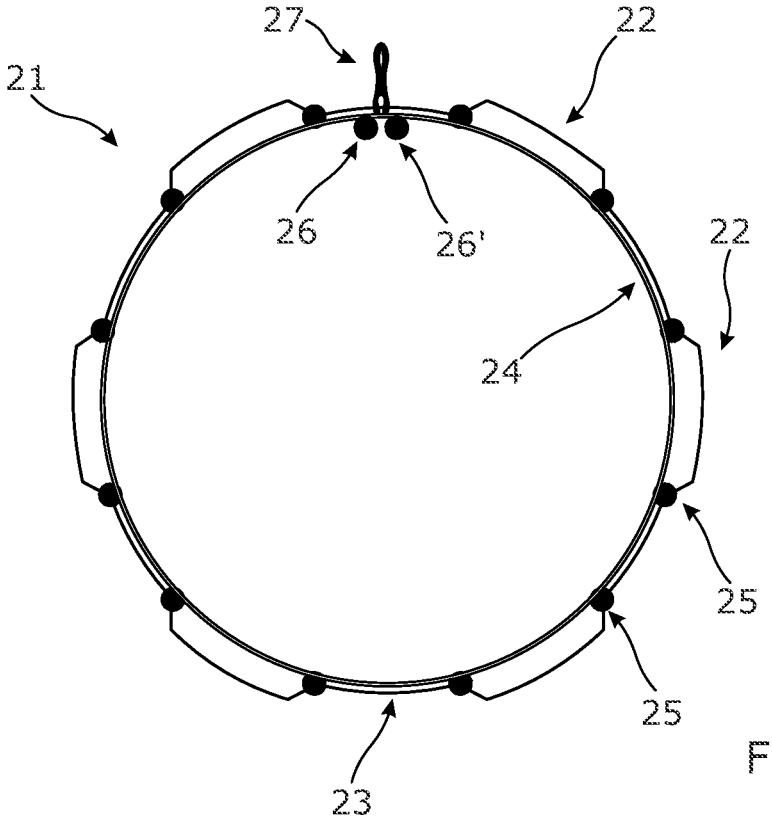
FIGS. 5 and 6 show in cross section examples of a lighting strip.
Figure 6:
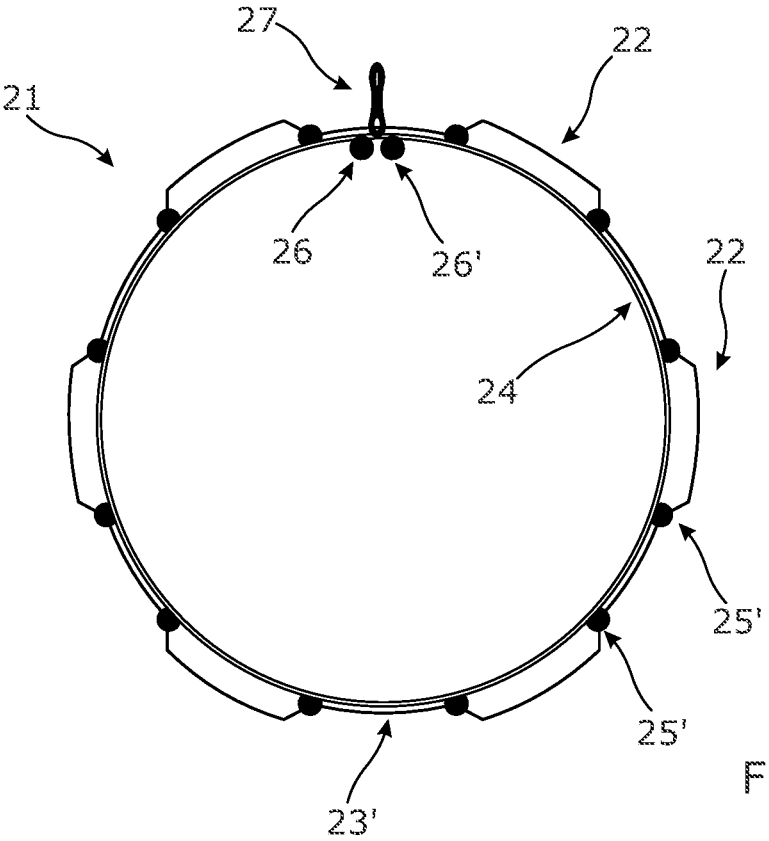

FIG. 4 shows an elevational view of a lighting element 6 in the form of a flexible strip 21 equipped with light-emitting diodes LEDs in its first strip state, that is to say in its first configuration in two dimensions (more particularly in roll-up strip). FIG. 5 shows the strip 21 in cross section in its second state deployed three-dimensionally in the form of a sleeve. FIG. 6 shows an alternative example of the strip 21 in cross section, in its second state deployed three-dimensionally in the form of a sleeve.

The strip 21 comprises strips of light-emitting diodes LEDs 22 which are generally parallel and longitudinally arranged in ribbon form. In the example of FIG. 5, these strips of parallel longitudinal LEDs 22 light-emitting diodes are fixed to a net 23 or connected to each other by a net 23, which is sewn to a fabric 24 (in particular coated and/or waterproof) based on nylon fibres. The seams 25 allow the assembly of the net 23 to the fabric 24, creating pockets for the LED ribbons 22.

In an alternative example in FIG. 6, these strips of light-emitting diodes 22 parallel longitudinal LEDs are positioned on a flexible support 24'. This flexible support 24' can be made of a fabric, for example based on nylon fibres. Alternatively or (and preferably) additionally, this flexible support 24' can be coated and/or waterproof. In this second example, these parallel ribbons of light-emitting diodes LEDs 22 are completed by a film 23' which is transparent or translucent, which is positioned over the ribbons of light-emitting diodes LEDs 22 as well as over the flexible support 24', and which is fixed to this flexible support 24' by fixing means 25' (in particular constituted by a weld, for example by high-frequency), this between the diode strips 22 and/or on either side of each strip of diodes 22. This flexible support 24' and this film 23' then define longitudinal cavities (in particular under the shaped like tunnels) inside which are positioned the strips of light-emitting diodes LEDs 22.

In the example illustrated, there are 26 parallel strips of light-emitting diodes LEDs 22, with a width of about 25 mm and a thickness of the order of 25 mm. The length of the strips may be between 2 meters and 4 meters. However other arrangements are possible. For instance, the number of these parallel strips of light-emitting diodes LEDs 22 can be between 4 and 12, preferably of the order of 8. FIG. 4 shows the two parts 26, 26' of the zipper with the opening/closing lever 27, which is used for forming the strip into a sleeve around the mast as described below. However other forms of fastening are possible, e.g. hook and loop fasteners at the edges, ties at the edges, "snap" connectors at the edges, etc.

In the lower part of the strip 21 and/or at least one end of this strip 21 (in particular at a lower end of this strip 21), the conducting wires from the LED strips 22 meet to form at least one output cable 8, which is partially hidden and protected by a transverse fold 29 of the fabric 24 or of the flexible support 24'. It is, more particularly, said strip 21 which comprises such a fold 29, more particularly at at least one end of this strip 21, in particular at the lower end of this strip 21. To ensure the protection of the output cable 8 by the fold 29, the latter is closed on said output cable 8. This closure is obtained by folding back on itself said fold 29 and fixing after folding, this by means of a mechanical closure, with which this fold is provided 29, and which consists of a mechanism of the hook type (in particular hook bands) and textile loops, of the type marketed under the name registered as the Velcro trademark.

The lighting assembly thus provides an area lighting system with the advantages of low weight, space requirement and implementation time. In essence, as we have seen before, a sleeve made up of a strip 21 provided with waterproof LED strips 22 is unwound and then fitted onto an extended mast. The mast may then be erected, as shown in FIG. 1, by installing top and bottom caps 3,4, which contain sockets for receiving the respective ends of the mast 2, and then tethering the guy ropes 5 to the ground. Alternatively, as shown in FIG. 7, a tripod 30 support may be provided to attach to and/or support the mast at its proximal end and/or along its length, and stabilise it on the ground 31. Alternatively, as shown in FIG. 8, the bottom cap 4 may have a stake 32 for being driven into the ground 31 to stabilise the mast 2.

Alternatively, as shown by FIG. 9, the assembly 1 may be fixed to a vehicle 35 (e.g. if necessary used to get to the site) by means of suction cups 36 with hooks/elastic ties (not shown), or by means of said at least one magnetic sole (in particular with hooks/elastic ties) or by other mechanical fixtures of a temporary or permanent nature designed for the specific vehicle. Attachment to a vehicle 35 can be done at the rear as on the side, depending on the vehicle, and more particularly depending on the nature of the walls at these locations of the vehicle. The adhesion of suction cups or magnetic soles, operating in pairs linked by elastic links, must be carefully controlled.

Then the connection of the installation allows the power supply forming part of the installation of the invention to supply the strips of LEDs with a supply voltage of, for example, 24 V from the mains via a transformer, or from a battery, or from solar or a portable generator, etc., according to the available supplies.

The assembly and disassembly of the entire installation requires two to three minutes for a single operator, without tools and without special training, the assembly steps resulting naturally from the design of the elements of the system. In essence, the operator unwinds the mast, which stiffens by returning to its tubular shape due to its internal resilient bias of the shell.

Then, the flexible strip 21 with strips of LEDs 22 is placed under the mast 2, so that one of their respective ends are substantially at the same level, and the longitudinal edges of the LED strip are joined and secured to using a zipper whose corresponding parts 26, 26' cooperate for this purpose. This forms a sleeve around the mast. The sleeve may be held in place via friction, if the sleeve is a snug fit, or ties, hooks, hook and loop or other means of connection may be used to keep the sleeve in position and prevent slip. The main part of the lighting assembly is then made.

The mast 2 is then erected, as described above, and connected to power 9. Thus, as applicable, the guy ropes 5 are pegged out, or the tripod 30 erected and attached to the mast, or the stake 32 driven into the ground. Where suction cups 36 are used to erect the lighting assembly, these may be fixed in pairs oriented substantially horizontally or vertically to a vertical wall, for example of a vehicle 35. The mast is then erected between the hooked suction cups of each pair and attached by means of elastic links cooperating with said hooks, typically elastic bracelets. Where one or more magnetic sole is used, this is fixed to such a vertical wall (for example of a vehicle) while the mast is raised relative to the magnetic sole (in particular between two magnetic soles) and is secured to said at least one magnetic sole (in particular by means of elastic links cooperating with said hooks, typically elastic bracelets). The connector 7 is then mated to the power supply 9 and the assembly is ready for use in mere minutes.

As shown by FIG. 10, the lighting element sleeve 21 may illuminate 360 degrees (or as close thereto as allowed by the fastening means at the edge of the strip of LEDs, e.g. at least 330 degrees). However, other arrangements are possible, for applications where more directional illumination is desired. Similarly, the sleeve is shown over the top portion of the mast. However, the sleeve may extend completely to the lower end of the mast if required.

Figure 11:
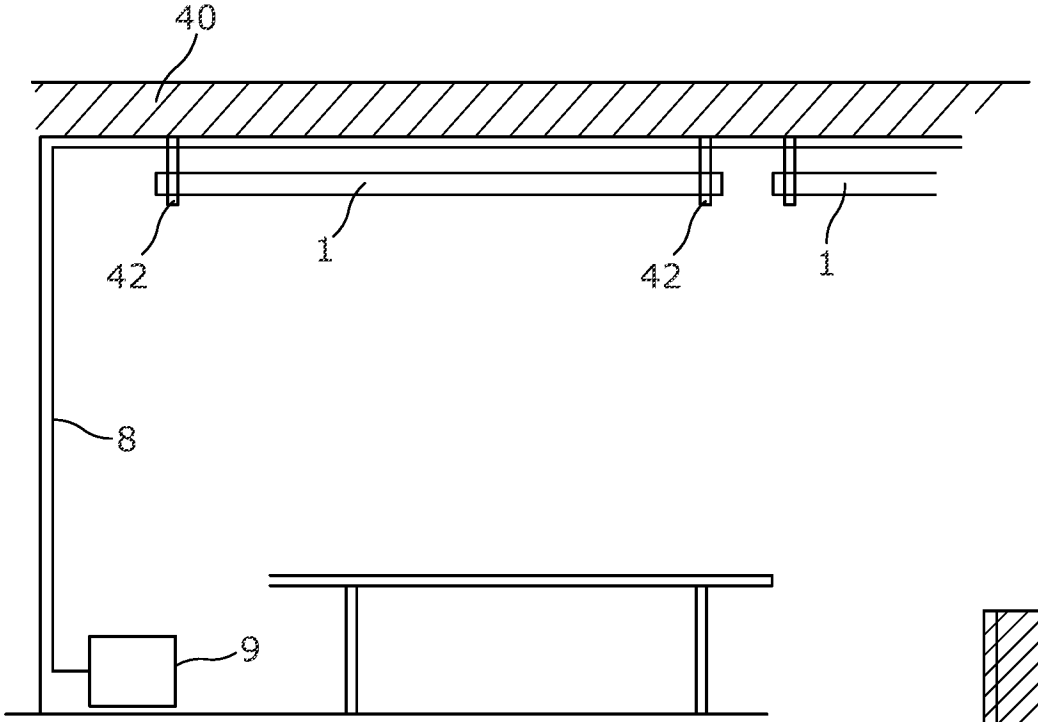
FIG. 11 shows another deployment of a lighting assembly.

FIG. 11 shows another example, where the lighting assembly 1 is used in a horizontal configuration, e.g. attached to the ceiling 40 or roof or the top of a tent, etc. The lighting assembly 1 may be mounted by any suitable connection means, e.g. hook and loop straps 42 placed at the ends or periodically along the mast, or mounting brackets, etc. In this example, the light emitting part of the sleeve 21 need not extend completely around the mast, as upward light is largely wasted. For instance, downward illumination through, e.g. 90 to 270 degrees, for instance 180 degrees, may be preferable. A connector may be provided at the distal end of the mast, such that multiple lighting assemblies may be daisy chained together. Thus, the first assembly connects to the power supply, whilst the next assembly connects to the first assembly distal connector, and so on.

The mast 2 is disassembled by following the above mentioned steps in reverse order. Thus, the mast 2 is dismounted, the power 9 is disconnected, and the sleeve 21 detached from the mast (not necessarily in this order). The mast 2 is then coiled into its compact form. Due to the preferred bistability of the mast, no external housing or constraint is needed to keep the tube in this form. The sleeve 21 is preferably also rolled up or folded up to a compact form. In some examples, the mast may be coiled around the rolled up sleeve, thus using the space inside the coil to reduce the overall space taken up. Or vice versa, the sleeve may be coiled around the mast.

In the examples described so far, the lighting element 6 forms a sleeve 21 enveloping the mast 2. However, in other examples, the lighting element 6 may only extend part way around the circumference of the mast, i.e. not bridge the slit in the STEM. The lighting element may be tied on by ties extending around the rest of the circumference, i.e. across the slit, as before. Alternatively, the lighting element may attach directly to the mast 2, e.g. hook and loop between the mast and lighting element, for instance running along the longitudinal edges.

In yet more examples, the lighting element 6 may be permanently fixed to the mast 2 and indeed form an integral part of it. This raises some additional challenges.

As the mast 2 and lighting element/light emitting elements 6 will comprise respectively dissimilar materials, in order to combine the functions of lighting element 6 and mast 2 in a single assembly 1 the dissimilar materials will need to be combined in such a manner that the lighting element 6 is not adversely affected by the repeated coiling and uncoiling of the STEM mast 2. This can be achieved for example as follows:

By attaching the lighting element 6 in such a manner as to allow it to slip relative to the material of the mast 2, thus isolating it from the strains occurring at the surface of the mast 2 during coiling and extension By forming the lighting element 6 from a material(s) that is capable of tolerating repeated cycles of extension and retraction In the case of a lighting element 6 that are loosely coupled, allowing slip relative to the STEM mast 2, any lighting element 6 may be used provided its nature is such that it does not interfere with the coiling of the STEM mast 2. In practice this means that it will usually be formed of a thin material, e.g. flexible OLEDs, strips of LEDs, etc. Whilst there may be a requirement for some thicker elements in the form of LED driving electronics, connectors, etc, that need to be sited close to the lighting element feed point, these need to be localised, such as to form a small, local discontinuity in the coiled profile of the STEM, such as not to interfere with its coiling. Where an electrical requirement may exist for a component with a physical size and shape such that it cannot be rolled interstitially with the STEM, the option exists to site it on the edge of the STEM. Alternatively, these can be positioned at the proximal end of the mast, or off mast where they do not need to be local to the LEDs themselves.

In an embodiment, the outer surface of the STEM 2 has a plurality of transparent or translucent "slats" at intervals along its length, or a fabric or other flexible covering a portion of the length of the mast where the lighting element are desired either continuously or at intervals. The slats or pocket material may be attached at its longitudinal sides to at two points across the STEM 2 such that a pocket (e.g. pocket 77 shown in the assembly 1 of FIG. 13) is formed behind the material, in which the lighting element 6 can be received. To ensure the lighting element 6 does not slip cumulatively over cycles of extension and retraction, one end of the lighting element 6 can be secured to the mast 2. It may be desirable to attach the other end to the mast 2 with an extensible elastic coupling in order to prevent buckling of the lighting element 6 and ensure smooth extension and retraction. In this way the lighting element 6 will be held under tension against the fixed attachment of the other end. Alternatively, the lighting element may be loosely "tacked" to the surface of the mast along its length to permits some degree of movement, whilst keeping the overall position.

If the light emitting elements of the lighting element 6 are to be bonded to the surface of the STEM or to a part of the STEM that is at a significant distance from the neutral axis, then the choice of material needs to be such that the extension and coiling of the STEM will not degrade its performance. It is expected that in most instances the light emitting elements will be at or close to the exterior surface, so the light can be transmitted from the mast. In practice this means using a material that can handle stresses, flex or stretch along the principal axes of the STEM. Conductors needed to form the circuits with the light emitting elements tend not to be extendible, although the substrates they are positioned on may be extensible. The simplest solution to this problem is to use a lighting element where the conductor traces lie at a significant angle relative to the principal axis of the STEM. For instance, where series of individual elements are used, e.g. LEDs, the conductors are orientated at angles to the principal axis of the STEM. The conductors may be mounted to a flexible membrane or directly incorporated into the mast as a substrate. LED elements themselves may be mounted on relatively rigid membrane elements, so as to shield their connections (e.g. soldered to pads on the conductors) from the stresses and strains experienced during rolling/unrolling. In addition, LEDs may be mounted at angles with serpentine conductive paths so that no lengthy part of a conductive trace lies along or transverse to the principal axis (it being appreciated that relatively short portions of conductive trace, e.g. less then 20 mm, may be more able to withstand such forces). For example WO2014186730 (Erogear) provides various methods of attaching LEDs to clothing which protect them against the stresses/strains experienced when applied to a "bendable" material, and these techniques may be found suitable in the present application. FIG. 12 shows an example of a lighting assembly where rows 72 of LEDs are bonded to the surface of the mast.

In other examples, the light emitting elements 6 may be embedded in the STEM structure such that they coincide with or move closer to the neutral axis of bending compared with the surface of the STEM and so are subjected to lower stresses and strains as the mast coils/uncoils as the path length differences between the two states of the BRC STEM are lower. The light emitting elements 6 may be embedded in the matrix of the BRC, e.g. between layers of fibre (where sufficiently translucent to allow light to escape without significant attenuation) or by shifting locally the alignment of fibres to accommodate the elements. Alternatively, the STEM may have partial cut outs for each element.

In most cases, the lighting element 6 will terminate electrically some distance from either end of the supporting STEM mast 2. Although electrical connection can be made to a separate cable 8 at the feed point of the lighting element 6, it is clearly desirable to be able to make this connection at some point convenient to the user. To this end, a cable may be embodied in the STEM mast 2 to connect the lighting element 6 to the connector 7.

One way of accomplishing this by running the cable 78 within a pocket 76 along the edge 16 of the STEM mast 2. By positioning the cable 78 at the edge, any increase in the overall thickness of the structure can be eliminated or kept to a minimum, so its affect on the ability of the mast 2 to coil is minimised. Alternatively, the cable may be positioned on the face of the mast, particularly where relatively thin in order to minimise any distortion during coiling. The pocket may allow some degree of slip of the cable relative to the mast to accommodate path length differences when coiled and extended. Alternatively, if the cable is robust, it may be bonded directly to the mast.

Alternatively, connection to the lighting element 6 can be accomplished by one or more thin conductive elements bonded to the surface of the STEM mast 2 running along its length. Alternatively, connection to the lighting element 6 can be accomplished by one or more thin conductive elements can be embedded within the material of the STEM mast 2 running along its length. These may be sinusoidal, zig zag or otherwise not aligned with the principal axis or transverse axis at a local level so as not to be aligned with the principal directions in which stresses arise on coiling/uncoiling.

The techniques described herein allow the production of STEM type masts 2 that integrate the lighting element function with that of the coilable mast 2, reducing pack size and often weight and greatly simplifying the deployment of lighting systems. As illustrated an example of a lighting assembly made according to the principles disclosed herein has a mast that is 4 meters high having a 7.5 cm diameter, with an elevated lighting element the bottom of which is located 1.5 m from the bottom of the mast. This lighting assembly 1 of FIG. 1 is capable of coiling into a cylindrical space 18 cm in diameter and 25 cm high, and weighs about 4 kg. Other configurations give rise to different packing dimensions and weights, depending on size and mounting arrangements. Other dimensions are possible of the tube are possible. BRC tubes likely to be between 10 mm and 100 mm in diameter and 0.5 m to 4 m in length. The lighting element may produce illumination of 30,000 lumens or more consistent with use to floodlight an outdoor area, although amount of light may be chosen according to the particular application.

Figure 13:
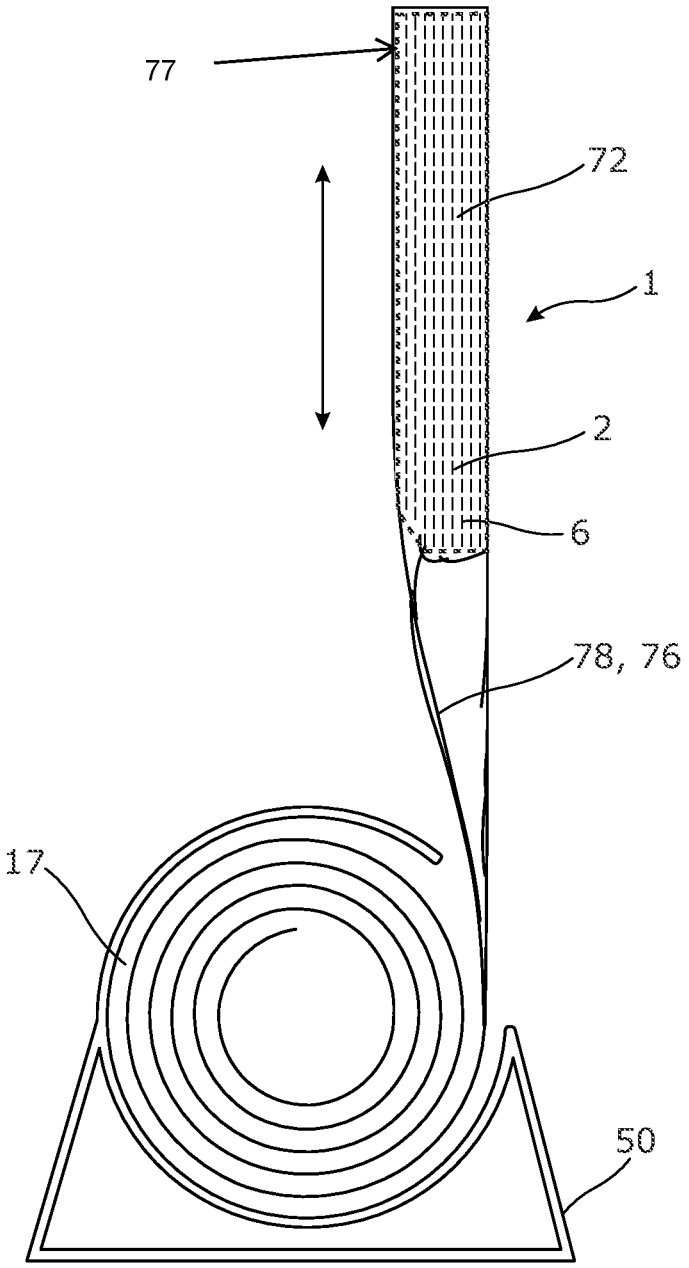
FIG. 13 shows another deployment of a lighting assembly.

The assembly 1 may be provided with a housing 50 which contains the coiled mast 2 from which it can be extended wholly or partially. The housing 50 may form a base for supporting the extended lighting assembly when deployed. FIG. 13 shows a housing 50 that provides a simple "push-pull" cassette, which holds the coil 11 in place and allows the mast 2 to be push-pull extended and retracted. The housing 50 may include a releasable mechanism that constrains the coiled portion 11 of the mast 2, such that releasing the mechanism allows the mast 2 to self coil. The housing 50 may include a hand-operated or motor driven mechanism for winding/extending the mast 2 that is arranged such as to drive the mast 2 between extended 12 and coiled 11 states. For example, a housing 50 comprising a pinch-wheel operable to drive the mast 2. The housing may also provide a connector 7*b* attached to the cable 78 by which connection is made to the lighting element 6.

Embodiments of the present invention have been described with particular reference to the example illustrated. However, it will be appreciated that variations and modifications may be made to the examples described within the scope of the present invention.

The invention claimed is:

1. A lighting assembly, comprising:

an extendible mast comprising a fibre reinforced composite constructed and arranged so as to be configurable between a coiled form and an extended form, wherein when extended the mast is resiliently biased in the form of an elongate tube having a slit along its length and wherein when coiled the mast is wound about an axis extending transversely to the longitudinal extent of the mast to have a compact form, wherein the mast is stable in both the coiled form and the extended form in that it remains in those respective forms in the absence of any external constraint; and a lighting element that is separable from the mast, wherein the lighting element comprises a flexible sheet supporting one or more light emitting elements, wherein the sheet is configurable as a sleeve and the dimensions in section of the deployed mast and of the sheet configured as a sleeve being provided so that said sleeve can be fitted onto the deployed mast to be supported by the mast and extending along at least a portion of the mast to deploy the lighting assembly for use;

wherein when the lighting assembly is not in use, the sleeve is separable from the mast and the lighting element is flattenable and then either foldable or rollable such that the lighting element has a compact form; and wherein when the mast and lighting element are in their compact forms, the lighting assembly is configured for portable storage.

2. The lighting assembly of claim 1, wherein the lighting element comprises plural strips of light emitting elements.

3. The lighting assembly of claim 1, comprising means for fixing the mast to the ground or to a wall or to a ceiling or to an object.

4. The lighting assembly of claim 3, wherein the sleeve is in the form of a strip which has attachment points allowing its longitudinal edges to be joined forming a sleeve to fit around the mast when deployed.

5. The lighting assembly of claim 1, wherein the mast comprises one or more of a fibre reinforced composite and a bistable material.

6. The lighting assembly of claim 1, comprising a connector for connecting the lighting assembly to a power source.

7. The lighting assembly of claim 1, comprising mounting fittings, being one or more of:

a top cap for fitting to the end of the mast, by which guy ropes can tether the mast in position on the ground;

a bottom cap for fitting to the bottom of the mast and positioning the bottom of the mast on the ground, optionally having a downwardly extending stake for anchoring the assembly in the ground;

a tripod or other stand for balancing the assembly on the ground and engaging with and positioning the mast at the desired orientation;

a spool for unwinding the assembly from the coiled position to an extended or part extended position;

one or more suction cups or magnetic cups for attaching the mast to a vehicle or other wall; or fixtures for attaching the assembly in a horizontal position to a ceiling, wherein the mounting fittings couple to the mast and support the mast in a deployed position.

8. The lighting assembly of claim 1, wherein the connector is a first connector and the assembly comprises a second connector spaced from the first connector by the lighting element, such that the first and second connectors are at substantially opposite ends of the mast thereby allowing a first lighting assembly to connected to a power source via its first connector and a second lighting assembly via its second connector when the first and second assemblies are positioned end-to-end, such that power to the second lighting assembly is received via the first lighting assembly.

9. A lighting assembly, comprising:

an extendible mast constructed and arranged so as to be configurable between a coiled form and an extended form, wherein when extended the mast is resiliently biased in the form of an elongate tube having a slit along its length and wherein when coiled the mast is wound about an axis extending transversely to the longitudinal extent of the mast to have a compact form; and a lighting element supported by the mast and extending along at least a portion of the mast, wherein the mast is constructed from a bistable material so as to be stable in both the extended and coiled form without any external housing or constraint being needed to keep the tube in each form, wherein the bistable material comprises a composite formed of plural layers of reinforcing fibre in a matrix material, and wherein the lighting element is permanently mechanically fixed:

a) to a surface of the bistable material, or b) between two layers of the plural layers of reinforcing fiber of the bistable material, an outer layer of the two layers being translucent or having one or more cutout portions overlying one or more corresponding light emitting portions of the lighting element to allow light to escape, such that the mast and the lighting element coil together to achieve a compact form for storage or portability.

10. The lighting assembly of claim 9, wherein the lighting element is constructed so as to have a first direction that is relatively more tolerant to stress or strain than a second direction, wherein the second direction is angled relative to the principal axis of the extended mast.

11. The lighting assembly of claim 9, wherein the lighting element comprises plural LEDs embedded into the matrix material.

12. The lighting assembly of claim 9, wherein the connector is a first connector and the assembly comprises a second connector spaced from the first connector by the lighting element, such that the first and second connectors are at substantially opposite ends of the mast thereby allowing a first lighting assembly to connected to a power source via its first connector and a second lighting assembly via its second connector when the first and second assemblies are positioned end-to-end, such that power to the second lighting assembly is received via the first lighting assembly.

13. The lighting assembly of claim 9, comprising mounting fittings, being one or more of:

a top cap for fitting to the end of the mast, by which guy ropes can tether the mast in position on the ground;

a bottom cap for fitting to the bottom of the mast and positioning the bottom of the mast on the ground, optionally having a downwardly extending stake for anchoring the assembly in the ground;

a tripod or other stand for balancing the assembly on the ground and engaging with and positioning the mast at the desired orientation;

a spool for unwinding the assembly from the coiled position to an extended or part extended position;

one or more suction cups or magnetic cups for attaching the mast to a vehicle or other wall; or fixtures for attaching the assembly in a horizontal position to a ceiling, wherein the mounting fittings couple to the mast and support the mast in a deployed position.

14. A lighting assembly, comprising:

an extendible mast constructed and arranged so as to be configurable between a coiled form and an extended form, wherein when extended the mast is resiliently biased in the form of an elongate tube having a slit along its length and wherein when coiled the mast is wound about an axis extending transversely to the longitudinal extent of the mast to have a compact form; and, a lighting element supported by the mast and extending along at least a portion of the mast, wherein the lighting element coils with the mast to achieve a stable coiled form, and wherein the lighting element is loosely coupled to the mast so the lighting element can slip relative to the mast when they extend or coil.

15. The lighting assembly of claim 14, wherein the mast comprises a pocket on a surface of the mast that receives the lighting element such that the lighting element can slip relative to the mast when extended or coiled.

16. The lighting assembly of claim 14, wherein the lighting element is tacked to the surface of the mast to allow relative movement as the mast is coiled and extended whilst keeping its overall position.

17. The lighting assembly of claim 14, wherein the connector is a first connector and the assembly comprises a second connector spaced from the first connector by the lighting element, such that the first and second connectors are at substantially opposite ends of the mast thereby allowing a first lighting assembly to connected to a power source via its first connector and a second lighting assembly via its second connector when the first and second assemblies are positioned end-to-end, such that power to the second lighting assembly is received via the first lighting assembly.

18. The lighting assembly of claim 14, comprising mounting fittings, being one or more of:

a top cap for fitting to the end of the mast, by which guy ropes can tether the mast in position on the ground;

a bottom cap for fitting to the bottom of the mast and positioning the bottom of the mast on the ground, optionally having a downwardly extending stake for anchoring the assembly in the ground;

a tripod or other stand for balancing the assembly on the ground and engaging with and positioning the mast at the desired orientation;

a spool for unwinding the assembly from the coiled position to an extended or part extended position;

one or more suction cups or magnetic cups for attaching the mast to a vehicle or other wall; or fixtures for attaching the assembly in a horizontal position to a ceiling, wherein the mounting fittings couple to the mast and support the mast in a deployed position.

19. A transportable area lighting installation, comprising:

a rectilinear mast, convertible between two states respectively folded or rolled into a compact volume and deployed in a rectilinear tubular configuration in the direction of the axis of the mast;

a flexible strip equipped with light-emitting diodes (LEDs), transformable between two states respectively into a winding strip and in the configuration deployed as a sleeve by fixing the two opposite longitudinal edges of the strip;

the dimensions in section of the deployed mast and of the strip configured as a sleeve being provided so that said sleeve can be fitted onto the deployed mast;

a power supply connected to the light-emitting diodes LEDs and provided with means of connection to a source of electrical energy; and means for temporarily fixing the mast to the ground or to a wall.

20. The transportable area lighting installation according to claim 19, wherein the mast comprises a flexible sheath which can be flattened in a direction perpendicular to its axis and rolled up in the direction of said axis.

21. The transportable area lighting installation according to claim 19, wherein the strip with LEDs comprises on its two longitudinal edges the two corresponding parts of a zipper over substantially its entire length.

22. The lighting assembly of claim 9, wherein the lighting element is permanently mechanically fixed between two layers of the reinforcing fibre, the outer layer of the two layers having plural cutout portions overlying plural corresponding light emitting portions of the lighting element, the outer layer of the reinforcing fibre being overlaid by a translucent layer to allow light to escape.

23. The lighting assembly of claim 9, wherein the lighting element is fixed between two layers of the reinforcing fibre so as to be close to the neutral axis of bending of the bistable member.

24. The lighting assembly of claim 9, wherein the lighting element extends along a first portion of the mast and the mast comprising a cable embodied in the mast along a second portion of the mast which is adjacent to the first portion to connect electrically from an end of the mast to the lighting element.

* * * * *